US007078653B2

(12) United States Patent
Hsieh

(10) Patent No.: US 7,078,653 B2
(45) Date of Patent: Jul. 18, 2006

(54) DIVING MASK WITH ADJUSTABLE INCLUDED ANGLE OF FRAME

(76) Inventor: Hsing-Chi Hsieh, No. 51, Wan An Street, Taipei (TW)

( * ) Notice: Subject to any disclaimer, the term of this patent is extended or adjusted under 35 U.S.C. 154(b) by 0 days.

(21) Appl. No.: 10/956,637

(22) Filed: Sep. 30, 2004

(65) Prior Publication Data

US 2006/0081582 A1 Apr. 20, 2006

(51) Int. Cl.
*B60L 1/02* (2006.01)

(52) U.S. Cl. ..... 219/203; 219/200; 219/201; 219/219; 219/221; 2/428; 2/430; 2/445; 351/126; 351/128; 351/124

(58) Field of Classification Search ..... 219/203, 219/200, 201, 219, 221; 2/428, 430, 445, 2/446, 440, 454; 351/126, 128, 124
See application file for complete search history.

(56) References Cited

U.S. PATENT DOCUMENTS 5,074,652 A * 12/1991 Addy ..... 359/600
6,119,278 A * 9/2000 Kawashima ..... 2/428

* cited by examiner

*Primary Examiner*—Shawntina Fuqua
(74) *Attorney, Agent, or Firm*—Pro-Techtor Int'l Services

(57) ABSTRACT

An adjustable diving mask with a frame assembly has two-frames for mounting two lenses, and an angle adjusting mechanism mounted between the two frames for adjusting the included angle between the two frames, and accordingly, the included angle between the two lenses. The angle 10 adjusting mechanism includes a tight fit shaft having a tapered section and a non-circular section, about which the first and the second frame could be pivotally turned relative to each other to obtain a desired included angle between them.

7 Claims, 3 Drawing Sheets

DIVING MASK WITH ADJUSTABLE INCLUDED ANGLE OF FRAME

FIELD OF THE INVENTION

The present invention relates to a diving mask with adjustable included angle of frame, and more particularly to a diving mask having a left and a right lens frame that could be pivotally turned about a shaft relative to each other, such that an included angle between the two frames most comfortable for a user could be obtained to widen a range of vision of the user under water.

BACKGROUND OF THE INVENTION

A diving mask generally includes a frame for a lens to mount therein, a soft skirt mounted to a rear side of the frame for covering a user's face, and a strap connected at two ends to two rear outer sides of the frame for adjustably binding around the user's head.

Conventionally, the frame of the diving mask is integrally formed to horizontally extend in a straight line. In the case the frame includes a left and a right frame that are connected to each other, and two lenses are separately mounted in the left and the right frame, the two lenses are also located within a straight line.

However, the conventional diving mask with two lenses located within a horizontally extended straight line does not match a user's face that typically has two rearward inclined lateral sides, and is therefore not comfortable for wearing. Particularly, two outer ends of the horizontally extended frames would partially block the user's sight projected sideward. That is, the user's viewing field or viewing angle is undesirably narrowed.

SUMMARY OF THE INVENTION

A primary object of the present invention is to provide a diving mask with adjustable included angle of frame, so that an angle contained between a left and a right frame of the diving mask, and accordingly, an angle contained between two lenses mounted in the two frames, could be freely adjusted to enable comfortable wearing of the diving mask and widened range of vision under water.

To achieve the above and other objects, the diving mask of the present invention mainly includes a frame that consists of a first and a second frame for two lenses to mount therein, and an angle adjusting mechanism mounted between the first and the second frame for adjusting an included angle between the first and the second frame, and accordingly, the included angle between the two lenses.

The first frame is provided at an inner side adjacent to the second frame with a plurality of sideward projected and vertically spaced first rings, such that a first cavity is formed between any two adjacent ones of the first rings; and the second frame is also provided at an inner side adjacent to the first frame with a plurality of sideward projected and vertically spaced second rings corresponding to the first cavities defined on the first frame, such that a second cavity is formed between any two adjacent ones of the second rings to correspond to the first ring on the first frame.

The angle adjusting mechanism includes a tight fit shaft extended through the first and the second rings, so that the first and the second frame are pivotally turnable about the shaft relative to each other to adjust an angle contained between them and be locked to the adjusted angular position.

The shaft is extended into the first and the second rings from a first end of the first rings, and includes a head and a shank extended from the head to sequentially include a tapered section and a non-circular section. The non-circular section of the shaft is provided at a central area with an axially extended threaded hole. One of the first rings on the first frame defines a tapered bore corresponding to the tapered section of the shaft, and one of the second rings on the second frame defines a non-circular bore corresponding to the non-circular section of the shaft, such that the shaft could be axially moved forward or backward without being rotatable relative to the second frame. The angle adjusting mechanism further includes a locking screw being screwed into the threaded hole of the shaft via a second end of the first rings on the first frame. When the locking screwed is loosened from the threaded hole, the tapered section of the shaft is released from a tight contact with the tapered bore on the first frame to allow adjustment of the angle contained between the first and the second frame; and when the locking screw is tightened against the threaded hole, the tapered section of the shaft is caused to tightly press against the tapered bore on the first frame to lock the first and the second frame to the adjusted angular position.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
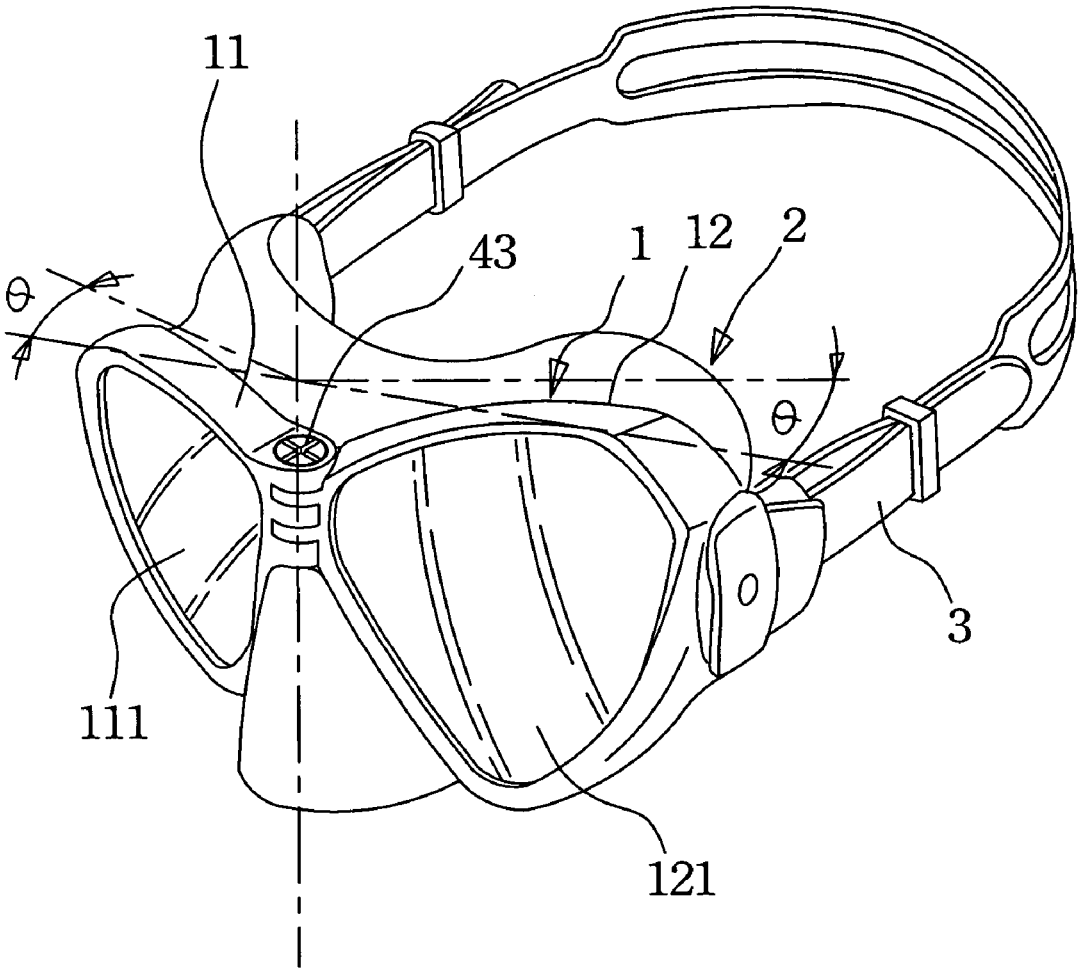
FIG. 1 is a perspective view of a diving mask with adjustable included angle of frame according to a preferred embodiment of the present invention.

Please refer to FIG. 1 that is an assembled perspective view of a diving mask with adjustable included angle of frame according to a preferred embodiment of the present invention. As shown, the diving mask of the present invention mainly includes a frame 1, a soft skirt 2 mounted to a rear side of the frame 1, and a strap 3 connected at two ends to two rear outer sides of the frame 1. The diving mask of the present invention is characterized in that the frame 1 has an adjustable included angle.

Figure 2:
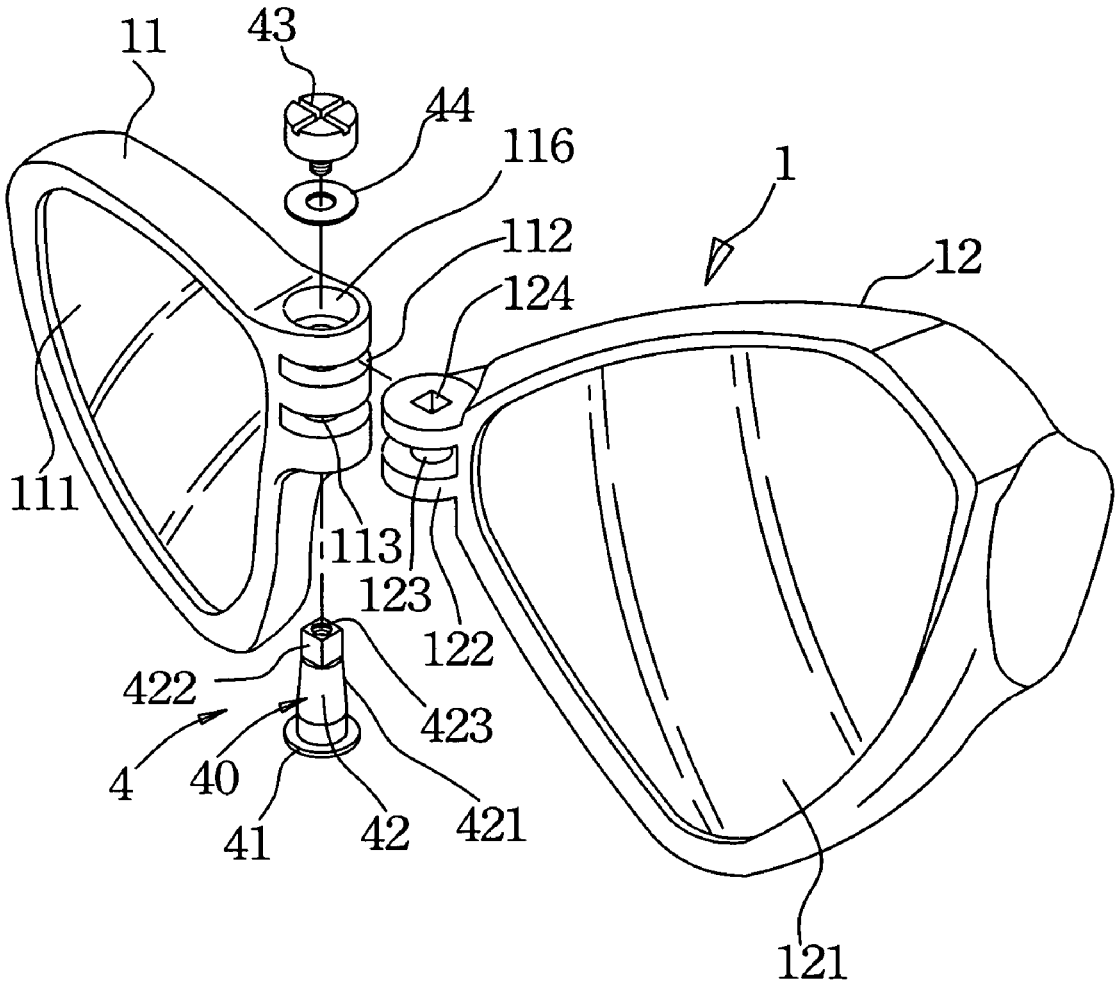
FIG. 2 is an exploded perspective view of the frame of the diving mask of the present invention.

More specifically, as can be seen from FIG. 2, which is an exploded perspective view of the frame 1 of the diving mask of the present invention, the frame 1 includes a first frame 11, which may be, for example, a left frame for a first or left lens 111 to mount therein; a second frame 12, which may be, for example, a right frame for a second or right lens 121 to mount therein; and an angle adjusting mechanism 4 mounted between the first and the second frame 11, 12 to enable adjustment of an included angle between the first and the second frame 11, 12, and accordingly, the included angle between the first and the second lens 111, 121.

The first frame 11 is provided at an inner side adjacent to the second frame 12 with a plurality of sideward projected and vertically spaced rings 112, such that a cavity 113 is formed between any two adjacent rings 112. The second frame 12 is also provided at an inner side adjacent to the first frame 11 with a plurality of sideward projected and vertically spaced rings 122 corresponding to the cavities 113 defined on the first frame 11, such that a cavity 123 is formed between any two adjacent rings 122 to correspond to the ring 112 on the first frame 11. The angle adjusting mechanism 4 includes a tight fit shaft 40 extended through the rings 112, 122 on the first and the second frame 11, 12, respectively, such that the first and the second frame 11, 12 could be turned about the shaft 40 relative to each other to adjust an included angle between them and then be locked to the adjusted angular position.

The shaft 40 is extended into the rings 112, 122 of the first and the second frame 11, 12 via a first end, such as a lower end, of the rings 112 of the first frame 11. The shaft 40 includes a head 41 and a shank 42. The shank 42 is extended from the head 41 to sequentially include a tapered section 421 and a non-circular section 422, such as a polygonal section, which may be, for example, a square section. The non-circular section 422 is provided at a central area with an axially extended threaded hole 423. Please also refer to FIG. 3 that is an assembled sectional view showing the angle adjusting mechanism 4 for the diving mask of the present invention. One of the rings 112 of the first frame 11, such as the middle one thereof, defines a tapered bore 114 corresponding to the tapered section 421 of the shaft 40. And, one of the rings 122 of the second frame 12, such as the uppermost one thereof, defines a non-circular bore 124 corresponding to the non-circular section 422 of the shaft 40. The non-circular bore 124 may be, for example, a polygonal hole, such as a square hole. With the non-circular bore 124 on the second frame 12 corresponding to the non-circular section 422 of the shaft 40, the shaft 40 could only be axially moved forward or backward relative to the second frame 12 without the possibility of being rotated. Therefore, the shaft 40 could be considered as an integral part of the second frame 12 in terms of it nature of non-rotatable relative to the second frame 12.

Figure 3:
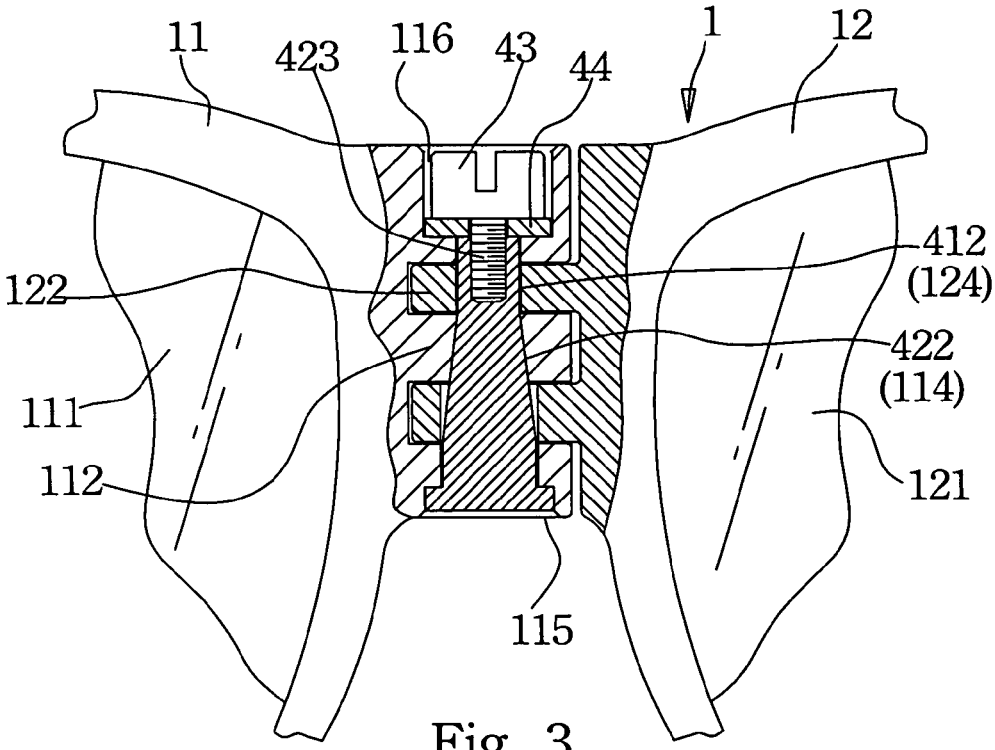
FIG. 3 is an assembled sectional view showing the angle adjusting mechanism for the frame of the diving mask of the present invention, wherein the angle adjusting mechanism is in a locked position.
Figure 4:
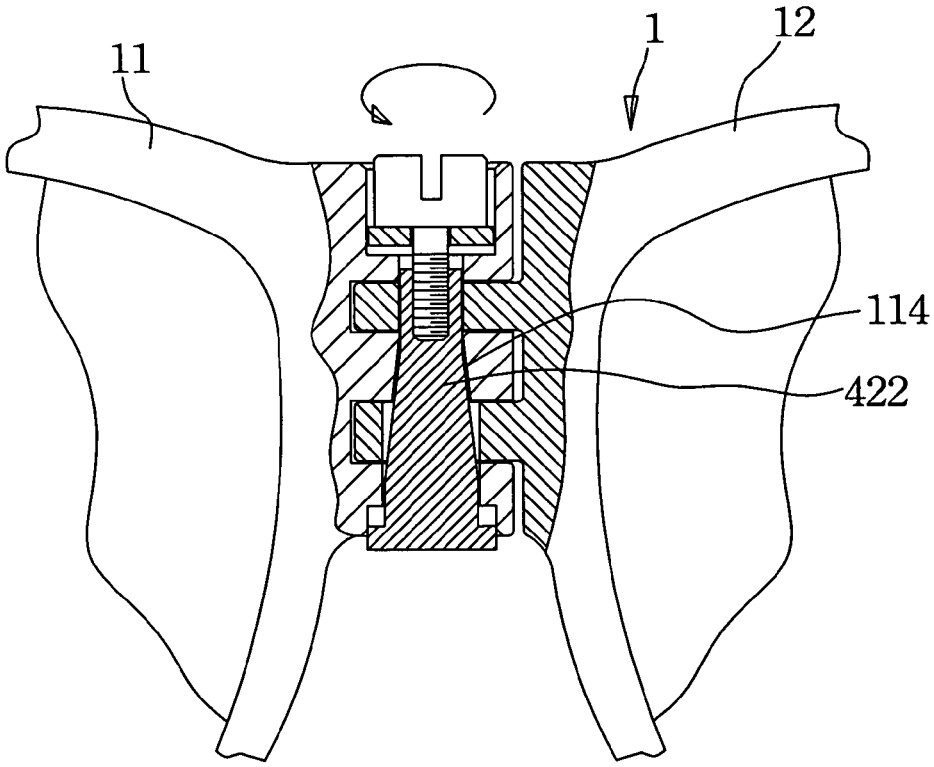
FIG. 4 is an assembled sectional view showing the angle adjusting mechanism for the frame of the diving mask of the present invention, wherein the angle adjusting mechanism is in an adjustable position.

The angle adjusting mechanism 4 also includes a locking screw 43, which is screwed into the threaded hole 423 of the shaft 40 via one ring 112 at a second end, such as an upper end, of the rings 112 of the first frame 11. When the locking screw 43 is loosened from the threaded hole 423 of the shaft 40, as shown in FIG. 4, the tapered section 421 of the shaft 40 is released from a tight contact with the tapered bore 114 on the first frame 11, and the first frame 11 is allowed to pivotally turn about the shaft 40 relative to the second frame 12 by a desired angle, so as to adjust and obtain an included angle between the first and the second frame 11, 12 that is most comfortable for a user to wear the diving mask. As can be seen from FIG. 1, when the first and the second frame 11, 12 are angularly adjusted rearward by a proper angle θ, it is possible to avoid two lateral outer sides of the frame 1 from blocking the user's vision when the user is viewing laterally outward. In other words, when the first and the second frame 11, 12 are angularly adjusted rearward by a proper angle θ, it is possible to widen a range of the user's vision under water. On the other hand, when the locking screw 43 is tightened against the threaded hole 423, as shown in FIG. 3, the tapered section 421 of the shaft 40 is caused to tightly press against the tapered bore 114 on the first frame 11, and the first and the second frame 11, 12 are locked to the adjusted angular position relative to each other.

A washer 44 is put around a lower side of the locking screw 43 for the latter to stably locate in the threaded hole 423 of the shaft 40.

A first and a second recess 115, 116 are respectively formed at the first and the second end of the rings 112 on the first frame 11 for receiving the head 41 of the shaft 40 and the locking screw 43, respectively, so that the head 41 of the shaft 40 and the locking screw 43 are flash with the first and the second end of the rings 112 on the first frame 11.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A diving mask with adjustable included angle of frame, comprising:

a frame assembly;

a soft skirt mounted to a rear side of said frame assembly; and a strap connected at two ends to two rear outer sides of said frame assembly; said frame assembly further comprising:

a first frame for a first lens to mount therein, a second frame for a second lens to mount therein, and an angle adjusting mechanism mounted between said first and second frame for adjusting an included angle between said first and second frame;

wherein said first frame is provided at an inner side adjacent to said second frame with a plurality of sideward projected and vertically spaced first rings, such that a first cavity is formed between any two adjacent ones of said first rings, and a second frame also being provided at an inner side adjacent to said first frame with a plurality of sideward projected and vertically spaced second corresponding to said first cavities defined on said first frame, such that a second cavity is formed between any two adjacent ones of said second rings to correspond to said first ring on said first frame; and wherein said angle adjusting mechanism includes a tight fit shaft extended through said first and second rings.

2. The diving mask with adjustable included angle of frame as claimed in claim 1, wherein said shaft is extended into said first and said second rings from a first end of said first rings, and includes a head and a shank extended from said head to sequentially include a tapered section and a non-circular section, said non-circular section of said shaft being provided at a central area with an axially extended threaded hole; one of said first rings on said first frame defining a tapered bore corresponding to said tapered section of said shaft; and one of said second rings on said second frame defining a non-circular bore corresponding to said non-circular section of said shaft;

wherein said angle adjusting mechanism includes a locking screw being screwed into said threaded hole of said shaft via a second end of said first rings on said first frame.

3. The diving mask with adjustable included angle of frame as claimed in claim 2, wherein said non-circular section of said shaft is a polygonal section, and said non-circular bore on said second frame is a polygonal hole corresponding to said polygonal section.

4. The diving mask with adjustable included angle of frame as claimed in claim 3, wherein said non-circular section of said shaft is a square section.

5. The diving mask with adjustable included angle of frame as claimed in claim 2, wherein said locking screw has a washer put around a lower side thereof.

6. The diving mask with adjustable included angle of frame as claimed in claim 2, wherein said first rings of said first frame is formed at said first end thereof with a first recess for receiving said head of said shaft therein.

7. The diving mask with adjustable included angle of frame as claimed in claim 2, wherein said first rings of said first frame is formed at a second end opposite to said first end with a second recess for receiving said locking screw of said angle adjusting mechanism therein.

* * * * *